US006666722B2

(12) United States Patent
Fukumori et al.

(10) Patent No.: US 6,666,722 B2
(45) Date of Patent: Dec. 23, 2003

(54) FUSE HOLDER

(75) Inventors: Shuichi Fukumori, Brussels (BE); Van Dessel Sonny, Haacht (BE)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/080,149

(22) Filed: Feb. 19, 2002

(65) Prior Publication Data

US 2002/0115347 A1 Aug. 22, 2002

(30) Foreign Application Priority Data

Feb. 22, 2001 (JP) ..... 2001-047353

(51) Int. Cl.[7] ..... H01R 13/68
(52) U.S. Cl. ..... 439/621
(58) Field of Search ..... 439/621, 250, 439/366, 622, 698, 830, 890, 949, 76.2, 620, 82; 29/883

(56) References Cited

U.S. PATENT DOCUMENTS

| | | | | |
|---|---|---|---|---|
| 3,378,808 A | | 4/1968 | French | |
| 3,848,951 A | | 11/1974 | Michaels et al. | |
| 4,094,564 A | * | 6/1978 | Cacolici | 439/604 |
| 4,184,733 A | | 1/1980 | Schmeling | |
| 4,230,387 A | | 10/1980 | Zahn | |
| 4,391,482 A | | 7/1983 | Czeschka | |
| 4,466,683 A | | 8/1984 | Ballarini | |
| 4,560,227 A | * | 12/1985 | Bukala | 439/621 |
| 4,943,248 A | | 7/1990 | Colleran et al. | |
| 4,944,684 A | * | 7/1990 | Leibowitz | 439/76 |
| 5,194,018 A | | 3/1993 | Lopata et al. | |
| 5,281,171 A | * | 1/1994 | Job | 439/621 |
| 5,409,399 A | | 4/1995 | Geoghegan et al. | |
| 5,552,951 A | | 9/1996 | Pasch et al. | |
| 5,632,654 A | * | 5/1997 | Sugiura | 439/621 |
| 5,752,856 A | * | 5/1998 | Boutin et al. | 439/621 |
| 5,785,537 A | | 7/1998 | Donahue et al. | |
| 5,926,952 A | * | 7/1999 | Ito | 29/883 |
| 6,089,918 A | | 7/2000 | Arakelian et al. | |
| 6,280,253 B1 | | 8/2001 | Kraus et al. | |
| D461,781 S | | 8/2002 | Fukumori et al. | |
| D462,061 S | | 8/2002 | Fukumori et al. | |
| 6,482,050 B1 | | 11/2002 | Lemke et al. | |
| 6,533,614 B1 | | 3/2003 | Akama et al. | |

FOREIGN PATENT DOCUMENTS

| | | |
|---|---|---|
| JP | 05342979 | 12/1993 |
| JP | 06150806 | 5/1994 |
| JP | 06231672 | 8/1994 |
| JP | 09245611 | 9/1997 |
| WO | 054992 | 3/2001 |

OTHER PUBLICATIONS

"Fuse Holder", by Shuichi Fukumori et al., U. S. patent application 10/080,151; Feb. 19, 2002, pp. 1 to 23 and 28 sheets of drawings.

"Multiple Fuse Holder", by Shuichi Fukumori et al., U. S. patent application 10/080,154; Feb. 19, 2002, pp. 1 to 27 and 34 sheets of drawings.

* cited by examiner

*Primary Examiner*—Ross Gushi
(74) *Attorney, Agent, or Firm*—W. F. Fasse; W. G. Fasse

(57) ABSTRACT

A fuse holder includes a holder housing having wide walls at the front and the rear and narrow walls on the right and the left, forming a chamber, which will hold the blade terminals and at least a part of the body of a fuse inserted therein. The fuse holder further includes two contacts, each of which has an intermediate part fixed to the holder housing, a connecting part at one end extending into the chamber to fit with a blade terminal, and a leg at the other end extending out of the holder housing to be soldered or press-fitted onto a printed circuit board.

15 Claims, 23 Drawing Sheets

FUSE HOLDER

CROSS-REFERENCE TO RELATED APPLICATIONS

This application is related to copending U.S. Patent Application Ser. Nos. 10/080,151 and 10/080,154, both filed on Feb. 19, 2002.

BACKGROUND OF THE INVENTION

1. Field of the Invention

The present invention belongs to a field of fuse holder, into which a blade type fuse, with blade terminals protruding from its body, is fitted.

2. Related Art

A fuse fitting device, into which a blade type fuse is fitted, is known. This device comprises a block of synthetic resin, and connecting terminals, which are inserted from below into a chamber in the block and fitted to a lance of the block. When this fuse fitting device is to be used, electric wires are connected to the connecting terminals, these connecting terminals are inserted into the chamber of the block and fitted to the lance, a fuse is inserted from above into the chamber of the block, and the blade terminals of the fuse are fitted into the connecting terminals to make connection (for example, refer to Japanese Patent unexamined publication gazette Heisei 6-150806).

When a plurality of fuses are to be fitted into this fuse fitting device, a new block must be newly designed whenever the combination of fuses is modified. It is inevitable to produce a mold for the block in each occasion, and in turn, the production of the fuse fitting device is costly.

SUMMARY OF THE INVENTION

The present invention was made in view of these points, and one objective of the invention is to propose a fuse holder wherein a holder housing is combined with contacts, mount this fuse holder on a printed circuit board, load the printed circuit board in a casing or the like and produce a fuse fitting device, and easily realize any combination of fuses and reduce the production cost of the fuse fitting device. Other objectives include to reduce the production cost by adopting fork-shaped contacts, and to guarantee high performance of the fuse fitting device by supporting these contacts by the holder housing and preventing the contacts from being pried.

To accomplish these objectives, the present invention is a fuse holder, into which a blade type fuse, with blade terminals protruding from the body thereof, is fitted, said fuse holder comprising a holder housing having wide walls at the front and the rear and narrow walls on the right and the left and forming, with these walls, a chamber, which will hold the blade terminals of a fuse inserted from the top side and at least a part of the body of the fuse, and two contacts, each of which has an intermediate part fixed to the holder housing, a connecting part, at one end, extending into the chamber to fit with a blade terminal, and a leg, at the other end, extending out of the holder housing to be soldered or press-fitted onto a printed circuit board.

When a fuse is fitted into this fuse holder, the blade terminals and at least a part of the body of the fuse will be held in the chamber of the holder housing and the blade terminals will be fitted into the connecting parts of the contacts. When the legs of the contacts are soldered or press-fitted onto a printed circuit board, the fuse holder with the fuse being fitted into the holder will be mounted on the printed circuit board. When conductive parts such as electric wires are connected to the pattern of the printed circuit board, the fuse will be electrically connected to the conductive parts. When the printed circuit board is loaded into a casing or the like, a fuse fitting device will be produced. When this fuse holder is used, a fuse fitting device can be made for any combination of fuses without newly designing a block. Hence the production cost is reduced. To complete a fuse fitting device, the fuse holder may be mounted onto the printed circuit board before fitting a fuse into the fuse holder.

Accordingly, with the use of the fuse holder of the present invention, a fuse fitting device can be produced for any combination of fuses without newly designing a block, and the production cost of the fuse fitting device can be reduced.

DESCRIPTION OF PREFERRED EMBODIMENTS OF THE INVENTION

Figure 1:
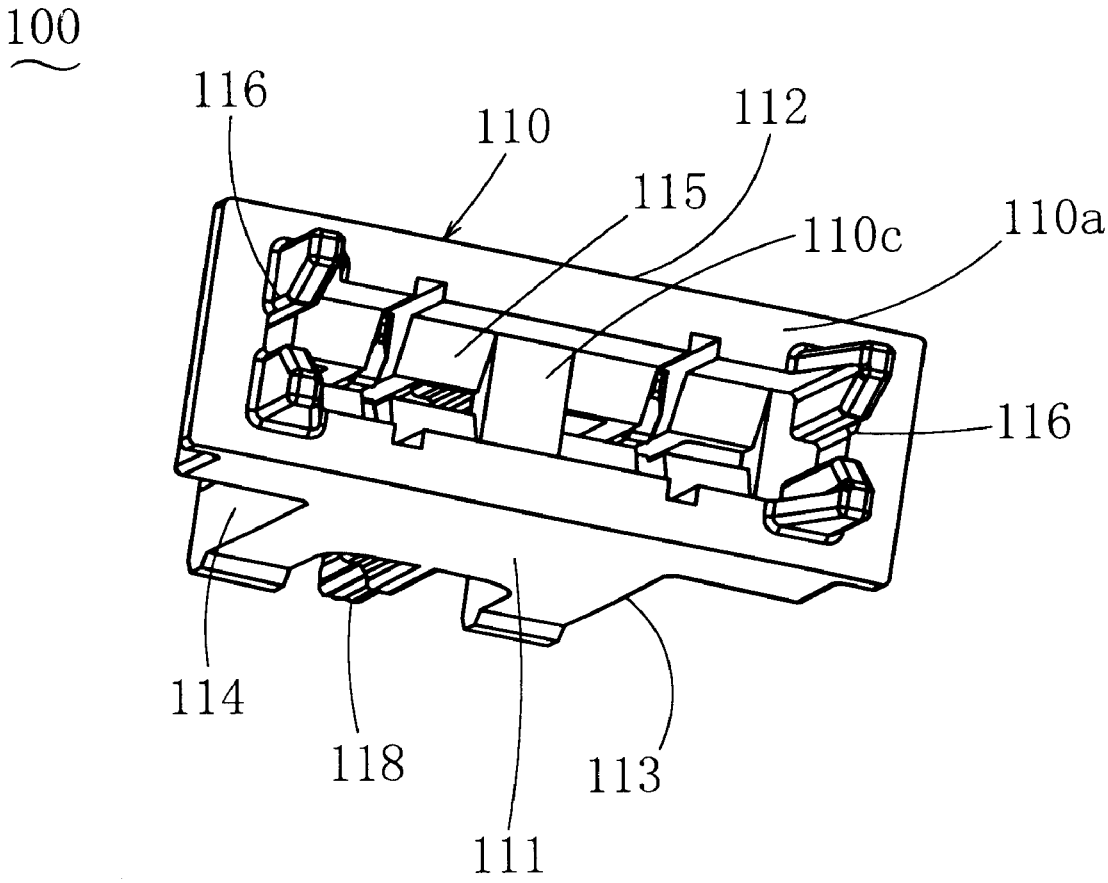
FIG. 1 is a perspective view of the first embodiment of the fuse holder seen from the top side thereof.
Figure 2:
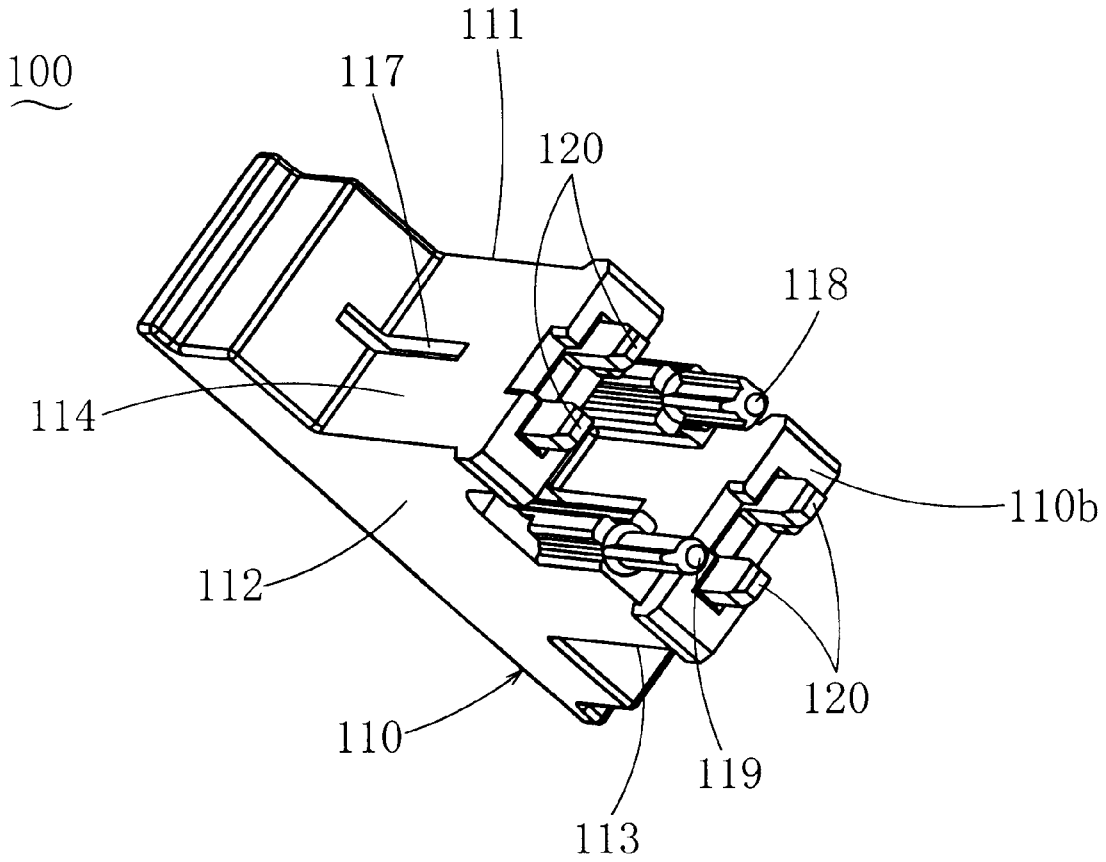
FIG. 2 is a perspective view of the first embodiment of the fuse holder seen from the bottom side thereof.
Figure 3:
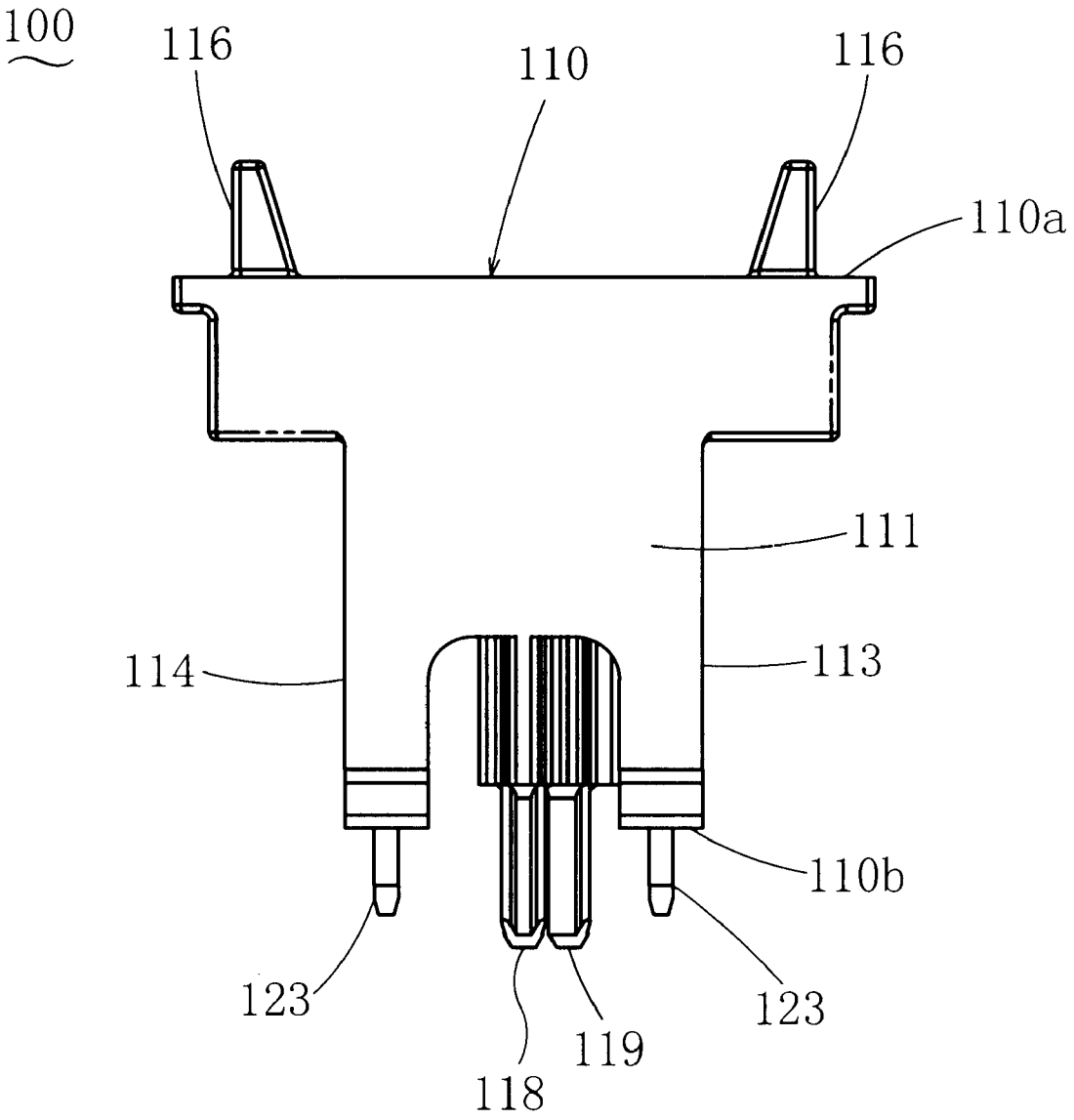
FIG. 3 is a front view of the first embodiment of the fuse holder.
Figure 4:
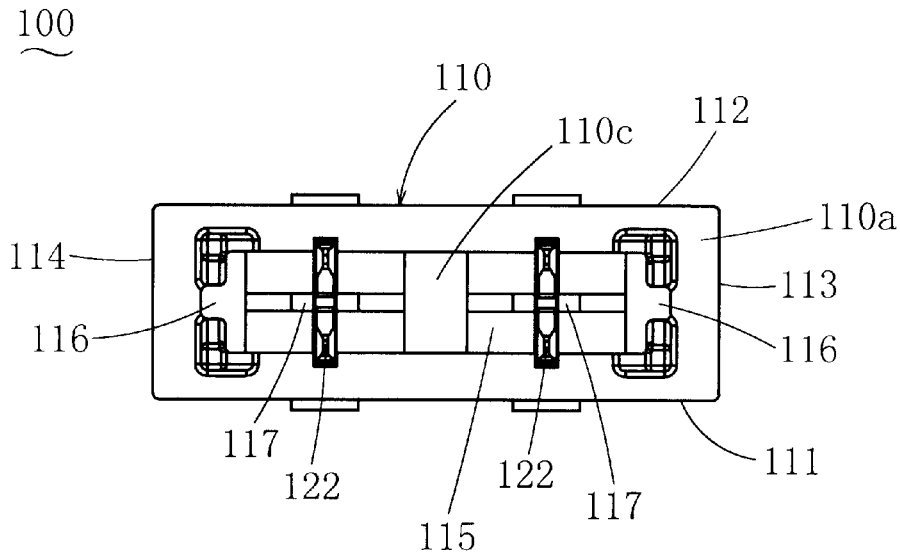
FIG. 4 is a plan view of the first embodiment of the fuse holder.
Figure 5:
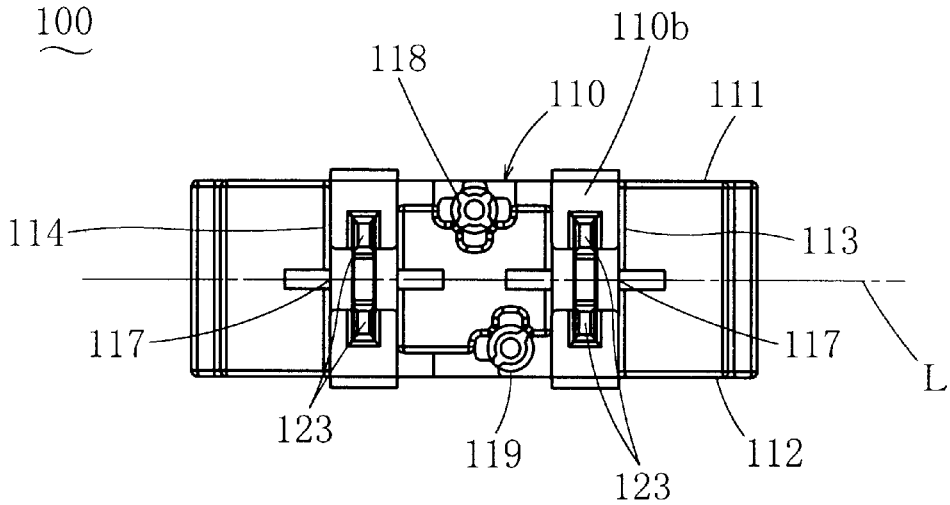
FIG. 5 is a bottom view of the first embodiment of the fuse holder.
Figure 6:
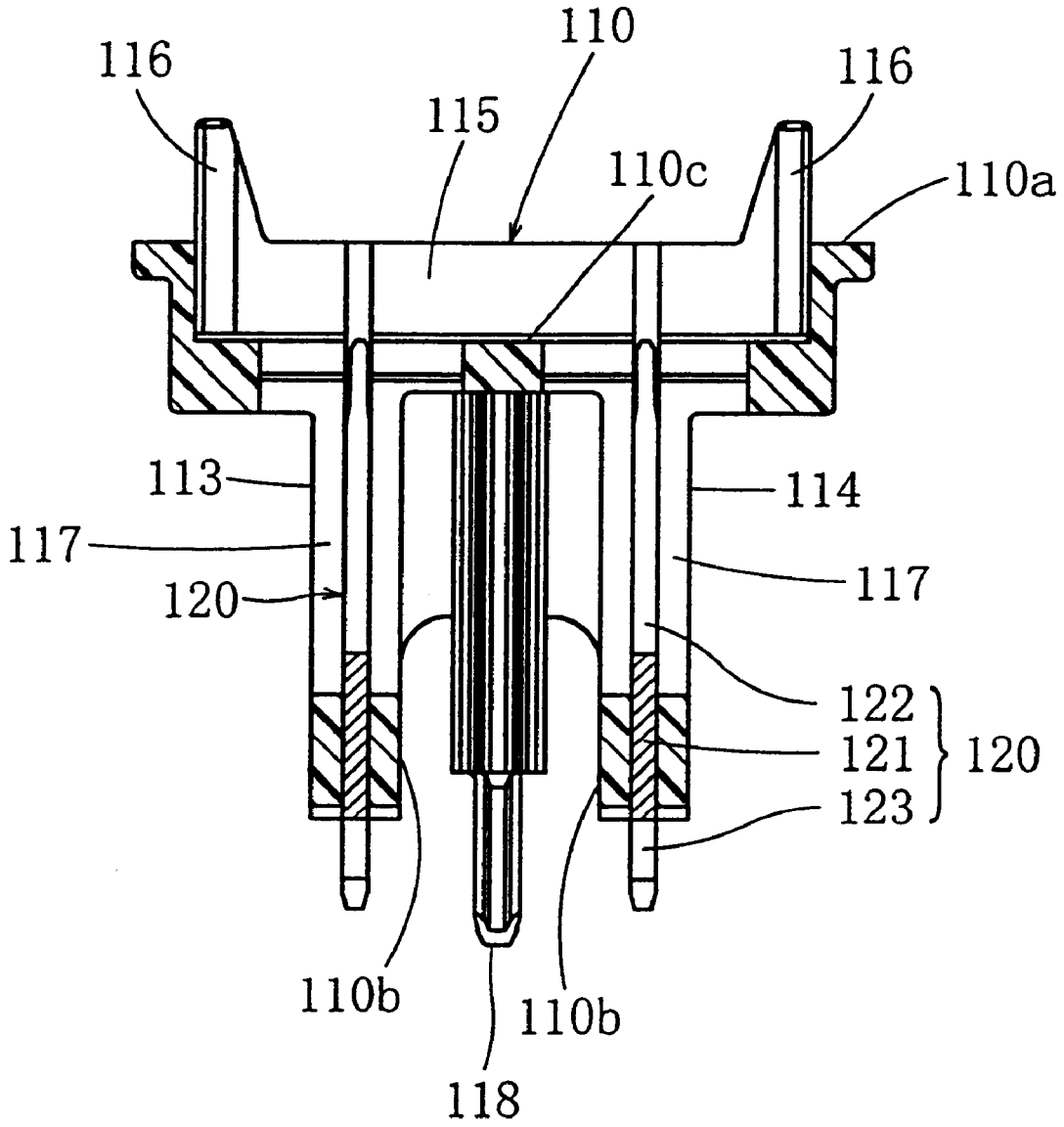
FIG. 6 is a vertical sectional view of the first embodiment of the fuse holder cut in both the left wall and the right wall thereof.
Figure 7:
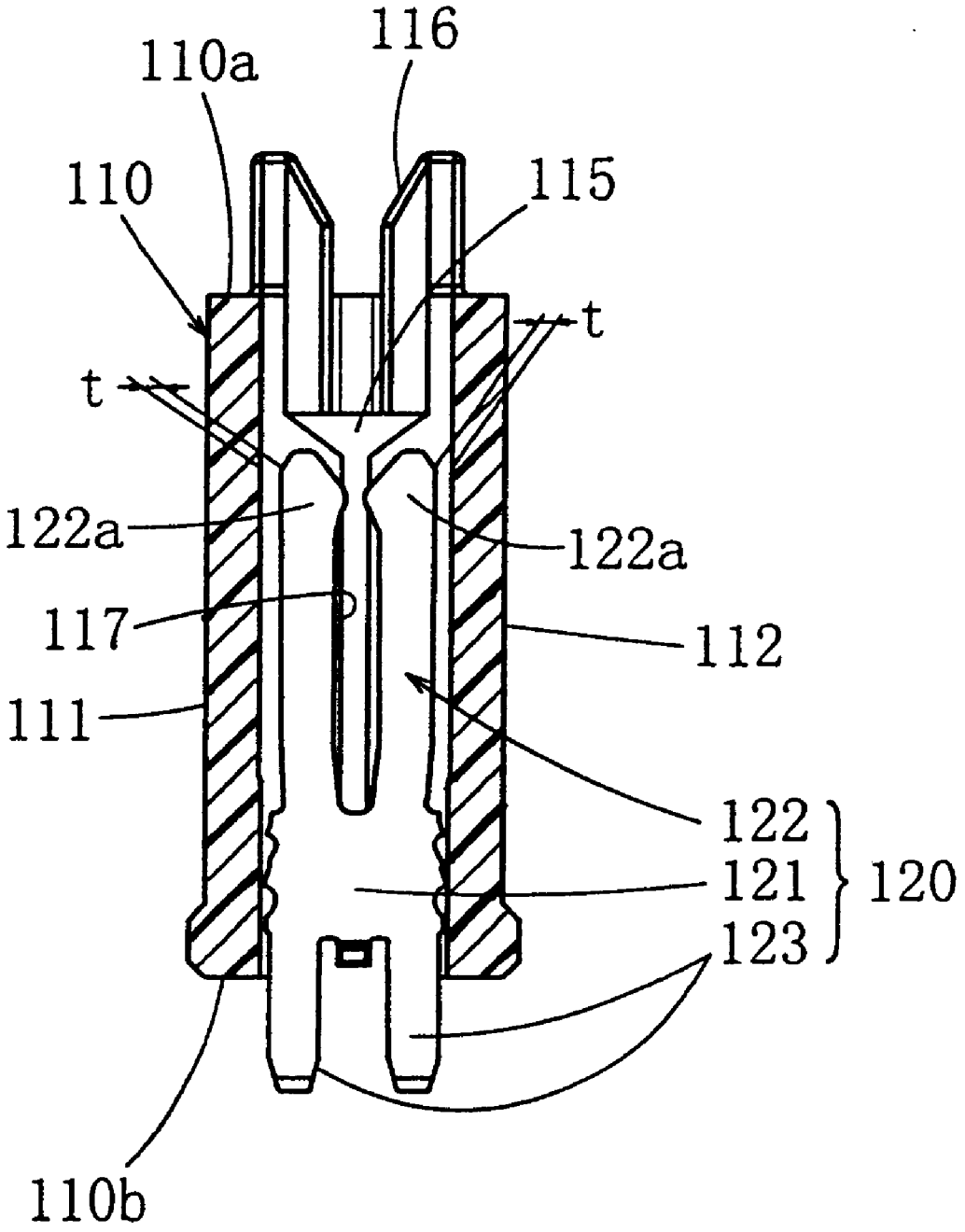
FIG. 7 is a vertical sectional view of the first embodiment of the fuse holder cut in both the front wall and the rear wall thereof.
Figure 8:
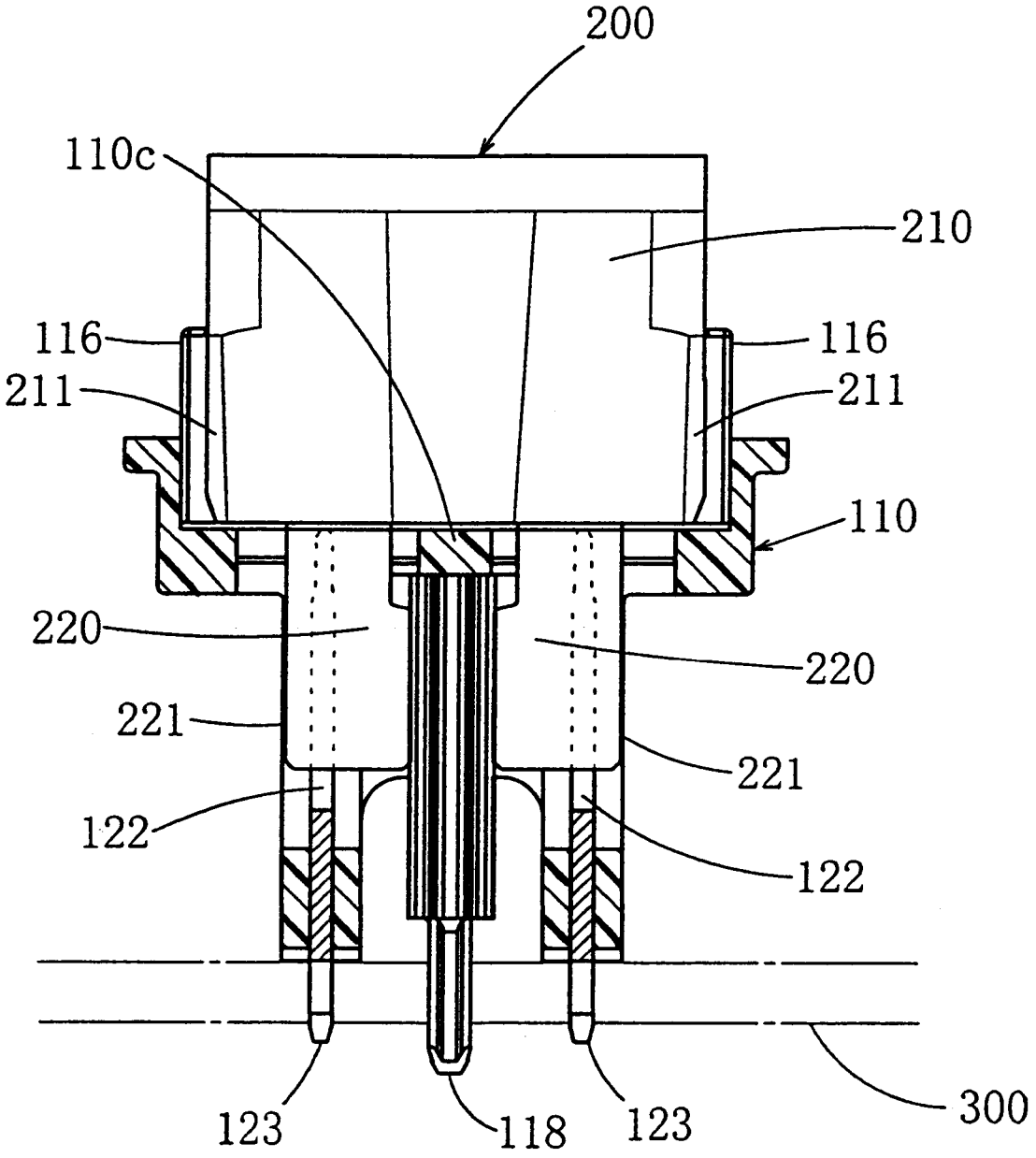
FIG. 8 is a diagram corresponding to FIG. 6 and shows the first embodiment of the fuse holder when a fuse is fitted into it.
Figure 9:
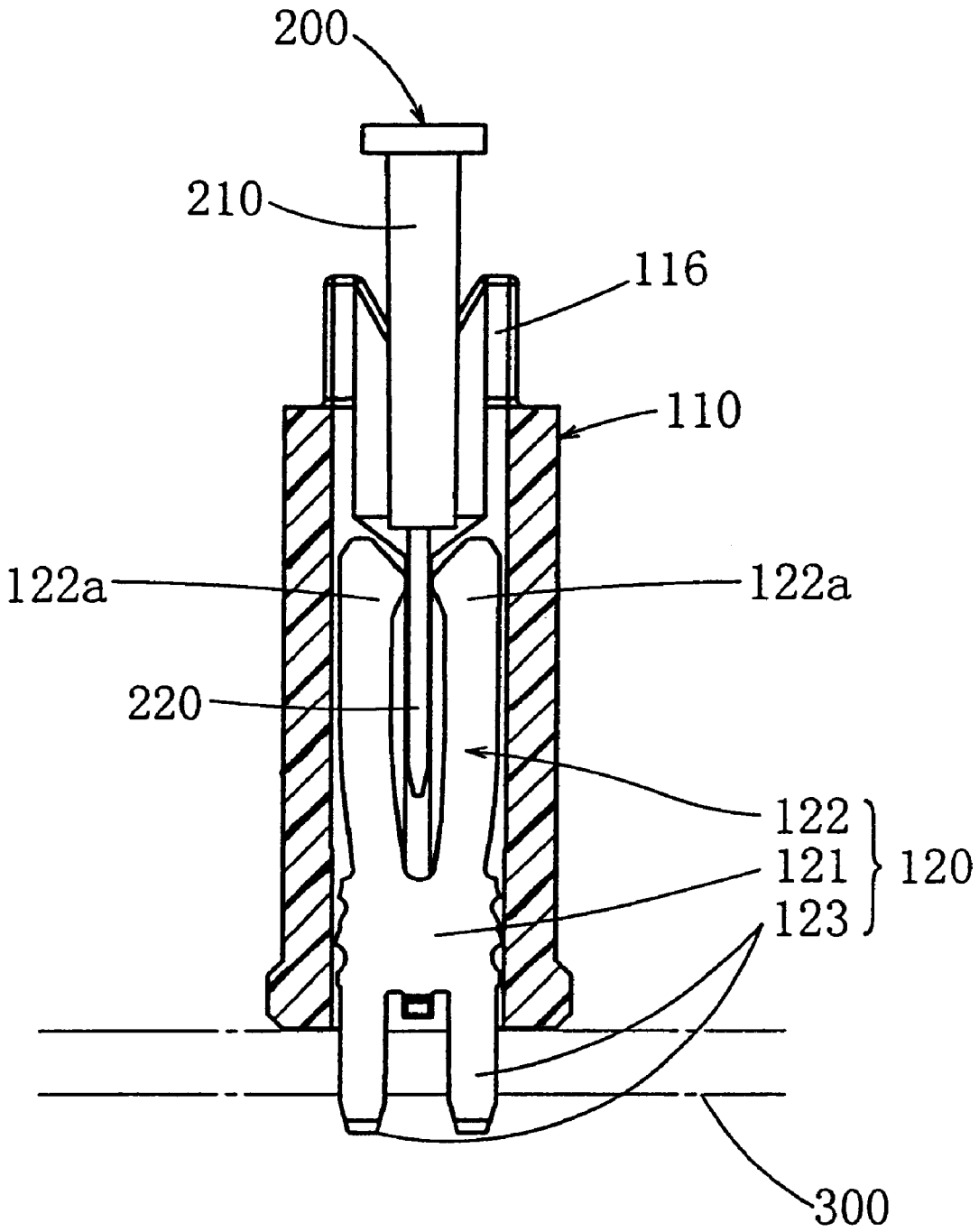
FIG. 9 is a diagram corresponding to FIG. 7 and shows the first embodiment of the fuse holder when a fuse is fitted into it.
Figure 10:
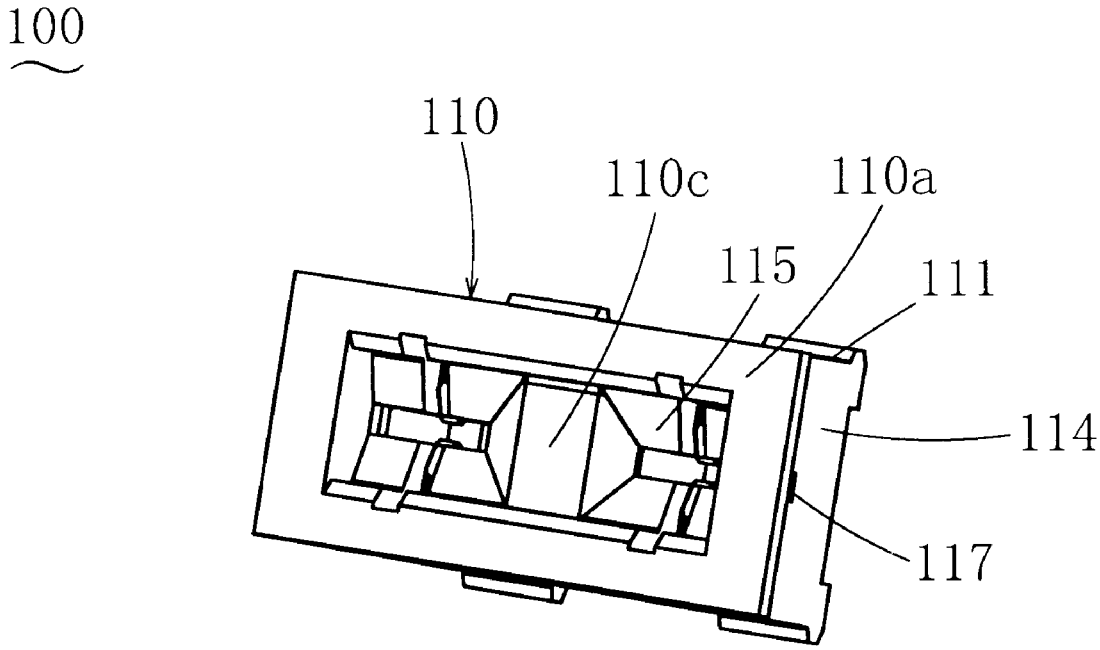
FIG. 10 is a perspective view of the second embodiment of the fuse holder seen from the top side thereof.
Figure 11:
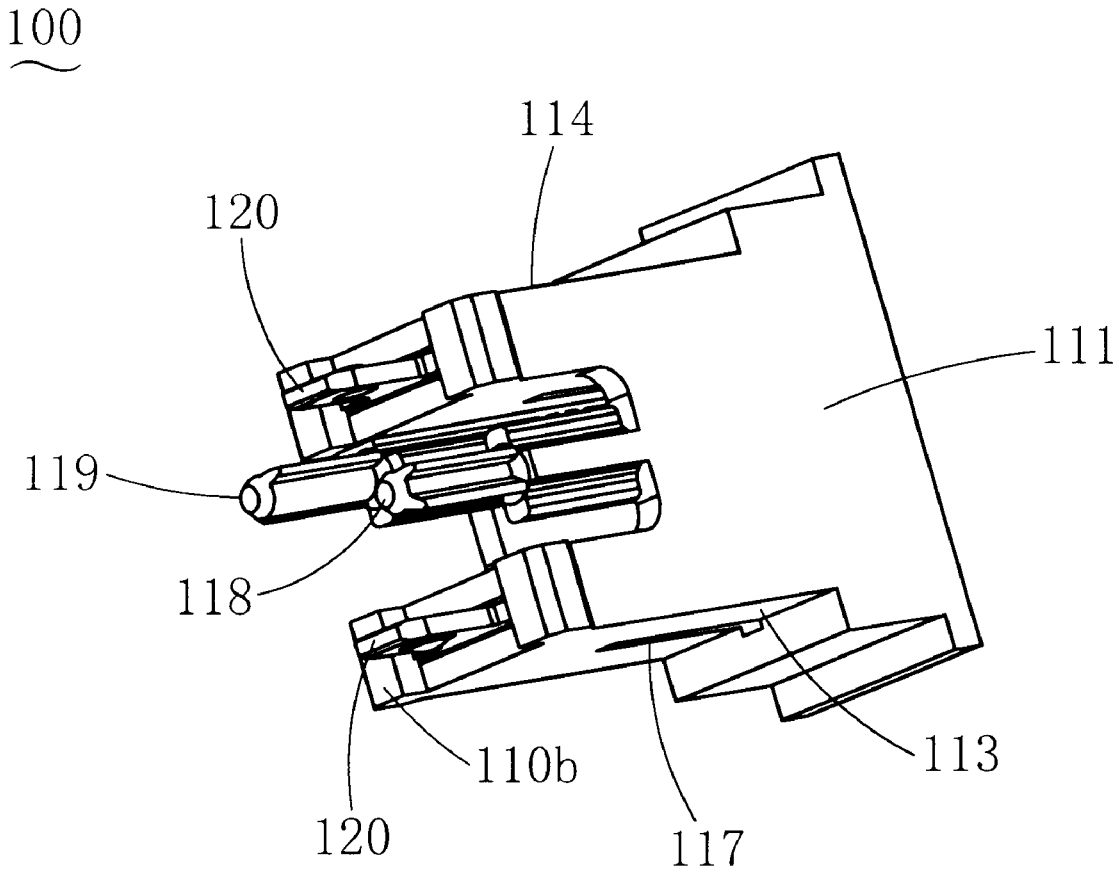
FIG. 11 is a perspective view of the second embodiment of the fuse holder seen from the bottom side thereof.
Figure 12:
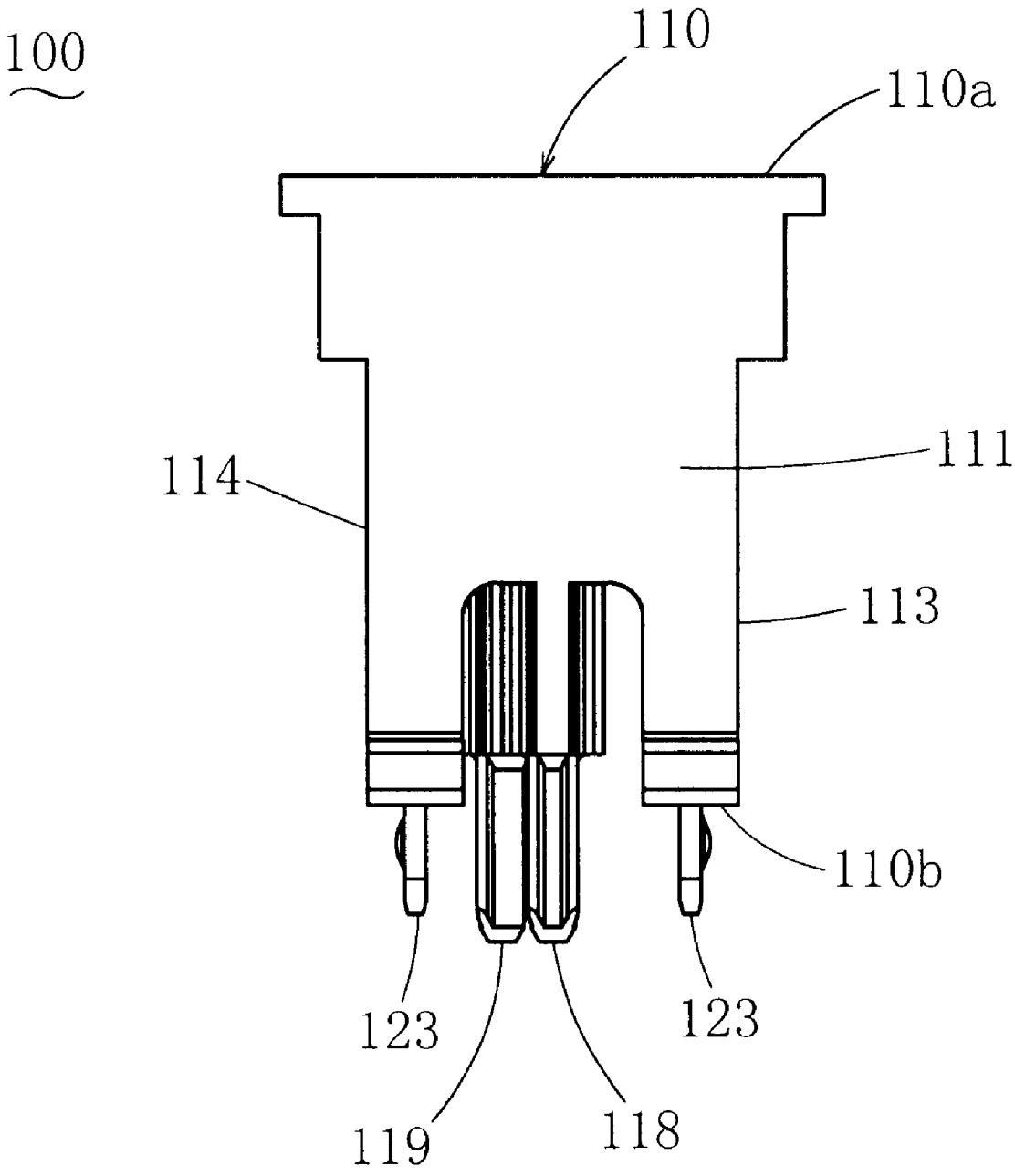
FIG. 12 is a front view of the second embodiment of the fuse holder.
Figure 13:
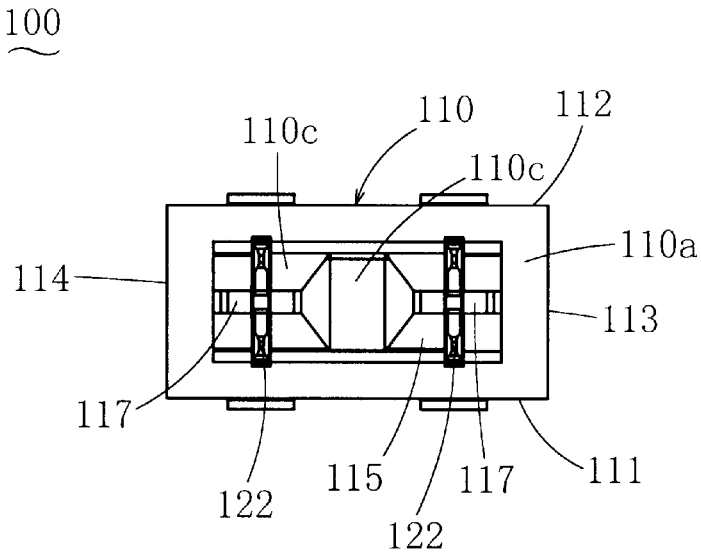
FIG. 13 is a plan view of the second embodiment of the fuse holder.
Figure 14:
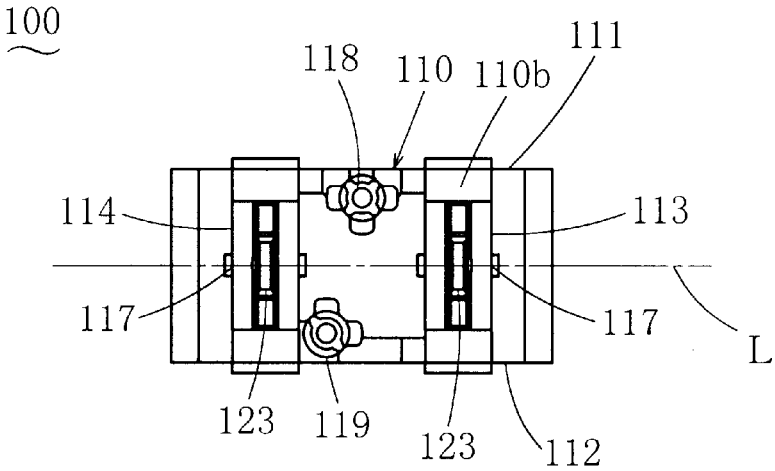
FIG. 14 is a bottom view of the second embodiment of the fuse holder.
Figure 15:
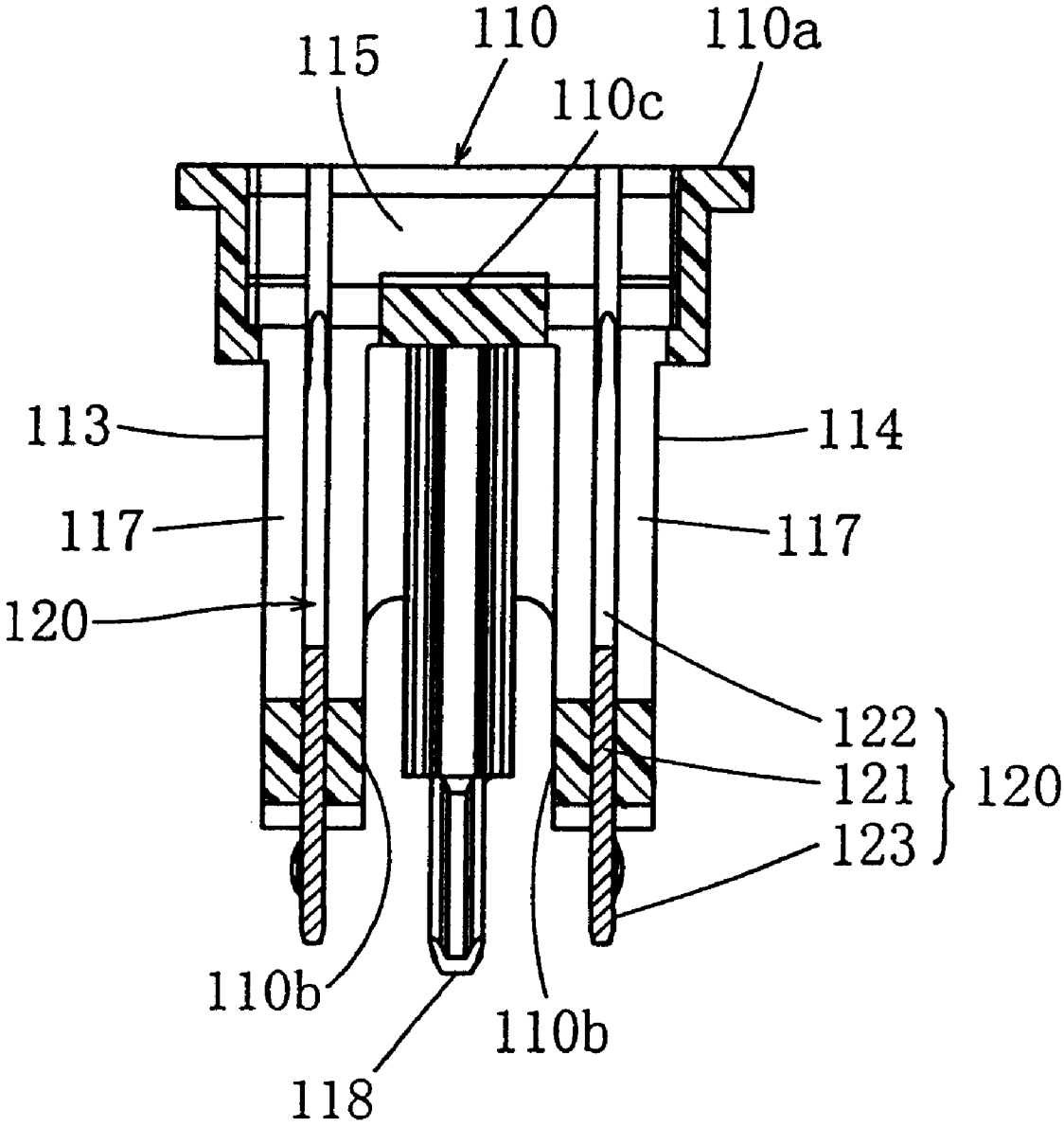
FIG. 15 is a vertical sectional view of the second embodiment of the fuse holder cut in both the left wall and the right wall thereof.
Figure 16:
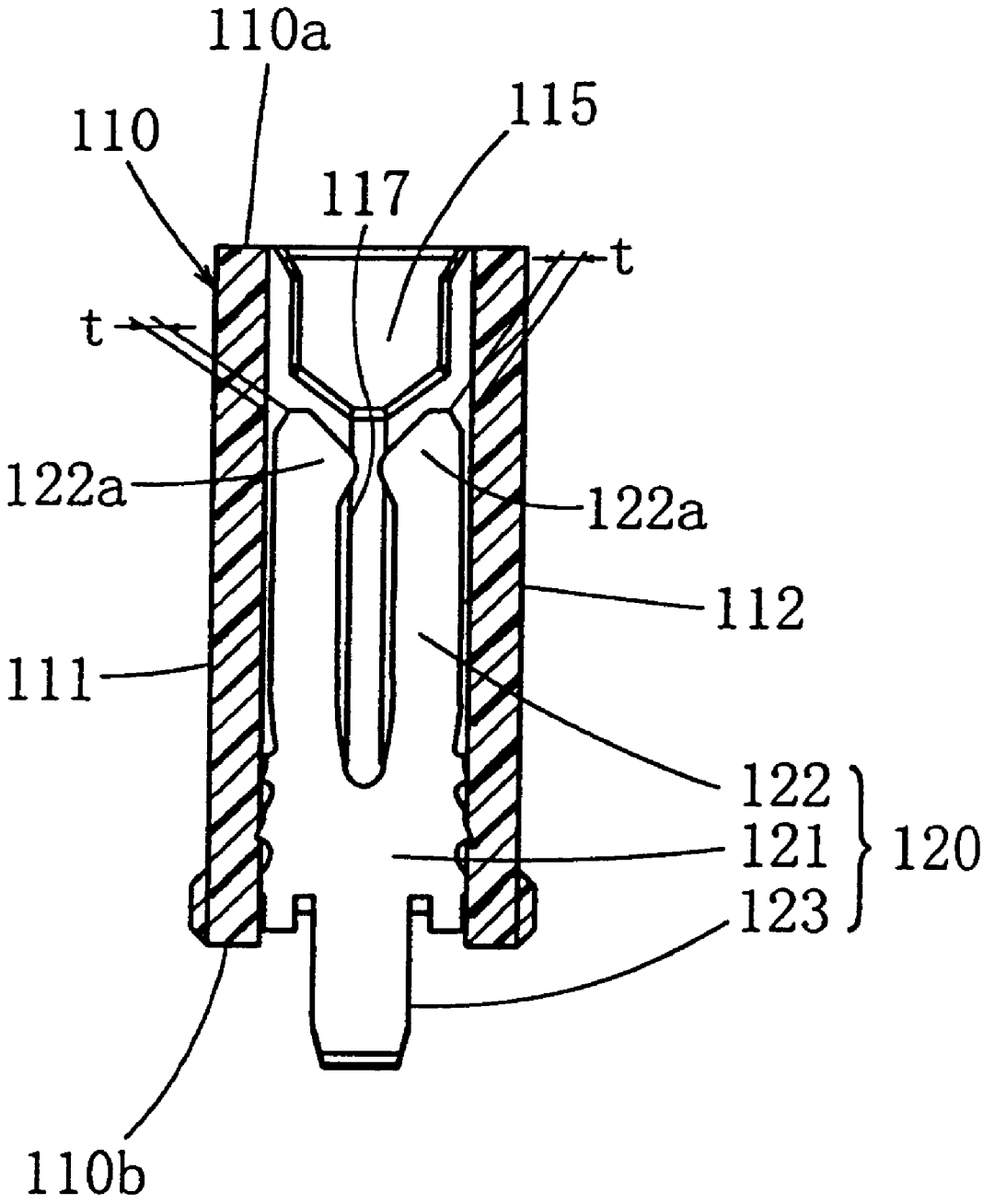
FIG. 16 is a vertical sectional view of the second embodiment of the fuse holder cut in both the front wall and the rear wall thereof.
Figure 17:
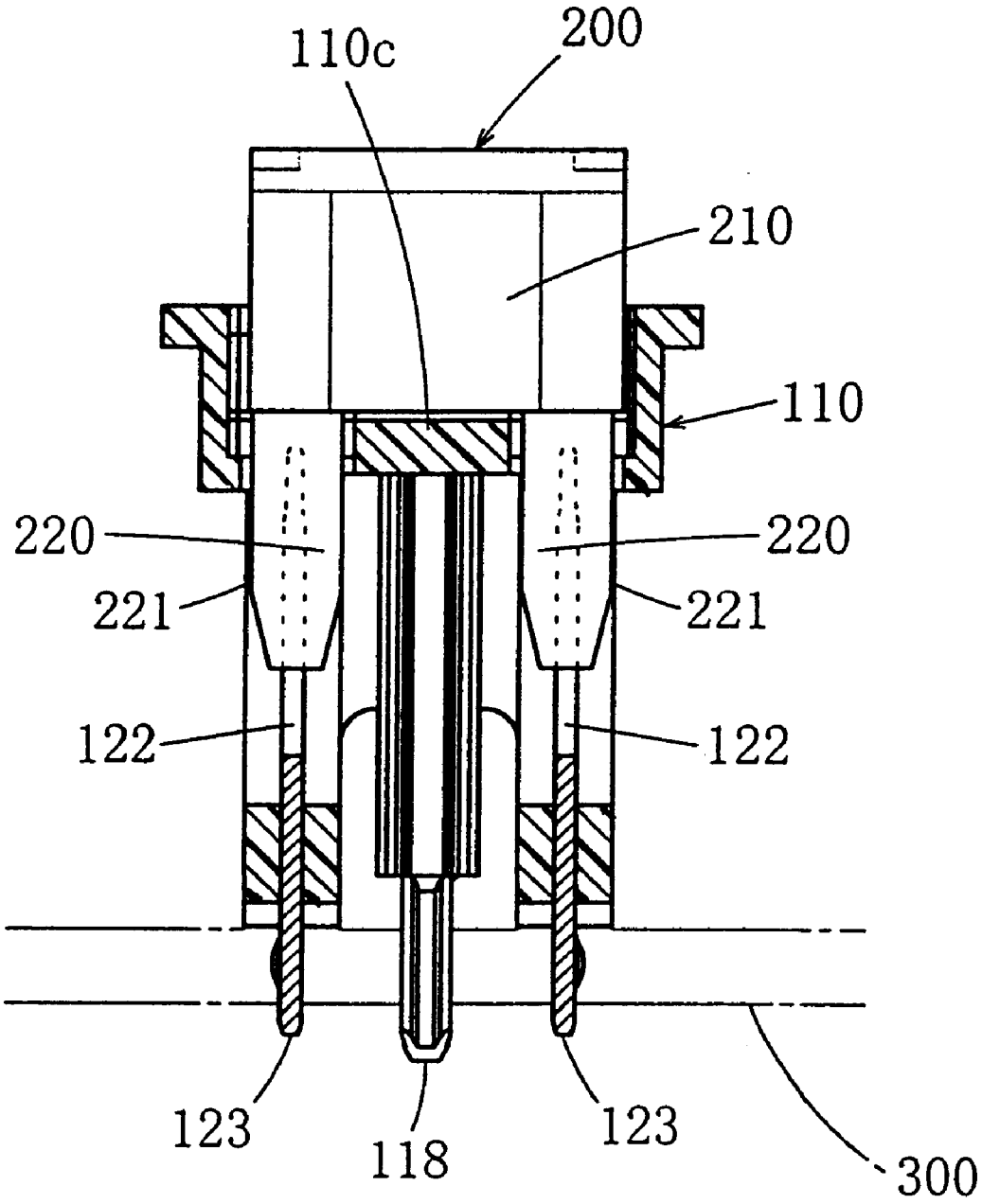
FIG. 17 is a diagram corresponding to FIG. 15 and shows the second embodiment of the fuse holder when a fuse is fitted into it.
Figure 18:
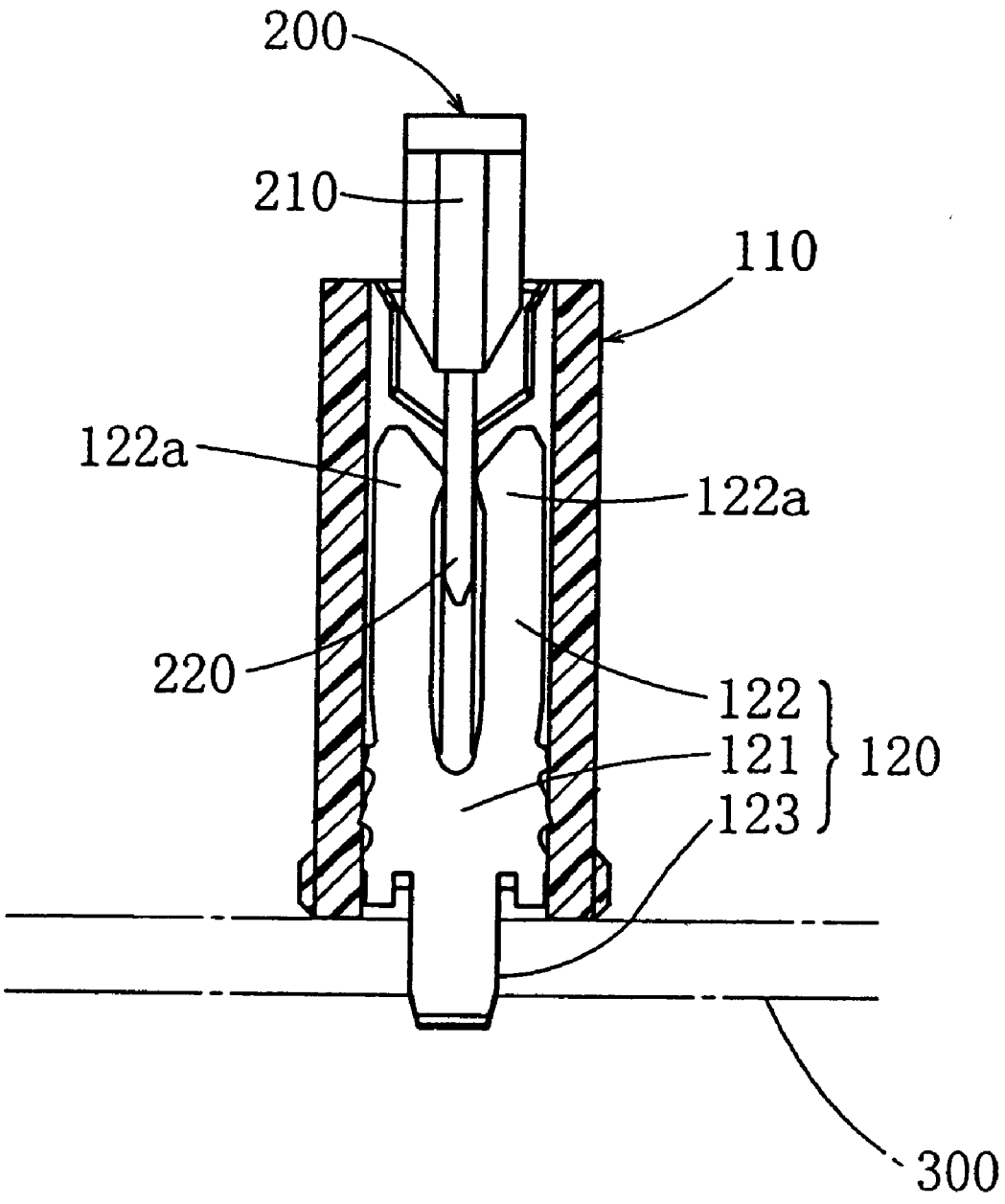
FIG. 18 is a diagram corresponding to FIG. 16 and shows the second embodiment of the fuse holder when a fuse is fitted into it.

In the following, some embodiments of the fuse holder according to the present invention will be described. A fuse to be fitted into this fuse holder is a blade type fuse 200, as shown in FIG. 8 and FIG. 9 and FIG. 17 and FIG. 18, with two blade terminals 220 protruding from the body 210 thereof. These fuses 200 have been standardized. The larger fuse 200 shown in FIG. 8 and FIG. 9 is of the maxi type, and the smaller fuse 200 shown in FIG. 17 and FIG. 18 is of the mini type.

FIG. 1 through FIG. 7 show the first embodiment fuse holder 100. A fuse 200 of the maxi type is fitted into this fuse holder 100. The fuse holder 100 comprises a holder housing 110 being made of an insulator and two contacts 120 being made of a conductor and fitted onto the holder housing 110.

The holder housing 110 has wide walls 111, 112 at the front and the rear, and narrow walls 113, 114 on the left and the right thereof. A chamber 115, which is through from the top 110*a* to the bottom 110*b* of the holder housing 110, is formed on the inner sides of the front wall 111, the rear wall 112, the left wall 113 and the right wall 114. The front, rear, left and right herein are used for convenience to indicate relative positional relationships. Accordingly, these directions are not related to the orientations of a printed circuit board 300, onto which the fuse holder 100 is to be mounted, and the casing, into which the printed circuit board 300 is to be loaded. When a fuse 200 is inserted into the holder housing 110 from the top side thereof, the blade terminals 220 of the fuse 200 and at least a part of the body 210 thereof will be held in the chamber 115. A portion of the holder housing 110 from a point between the top 110*a* and the bottom 110*b* and to the top 110*a* overhangs in the direction of alignment of the blade terminals 220. The body 210 of the fuse 200 is held by a horizontal wall 110*c*, which is inside the above-mentioned overhanging part.

A rib 211 is formed on each side end of the body 210 of the fuse 200 in parallel with the extending direction of the blade terminals 220. U-shaped supporting parts 116, into which the ribs 211 of the body 210 of the fuse 200 are to be fitted, are provided in the tops of the left wall 113 and the right wall 114 of the holder housing 110.

Slits 117, into which the side edges 221 of the blade terminals 220 are to be fitted, are provided in the left wall 113 and the right wall 114 of the holder housing 110.

Two bosses 118, 119 are provided on the bottom 110*b* of the holder housing 110. When seen from the bottom, the bosses 118, 119 are arranged asymmetrically relative to each other in relation to a line L, which runs between the front wall 111 and the rear wall 112 approximately in parallel to these walls.

An intermediate part 121 of each contact 120 is fixed to the bottom 110*b* of the holder housing 110. A fork-shaped connecting part 122 is provided on one end of the contact 120 to extend towards the inside of the chamber 115. This connecting part 122 is formed approximately into a U shape, and its two branches 122*a* are arranged to expand towards the front wall 111 and the rear wall 112 to fit with the blade terminal 220 with a certain contact pressure. A leg 123 is provided on the other end of the contact 120 to extend out of the holder housing 110. This leg 123 is soldered or press-fitted onto a printed circuit board 300.

The intermediate part 121 of the contact 120 is press-fitted into a space between the wall 111 and the wall 112 at the bottom 110*b* of the holder housing 110.

The leg 123 of the contact 120 is forked into two branches. In other words, it has two ends.

The clearances t between the connecting part 122 and the front wall 111 and the rear wall 112 of the holder housing 110 are set in such a way that they allow deformation of the connecting part 122 while limiting its excessive deformation. In other words, the clearances t are provided not to hinder expansion of the two branches 122*a* of the connecting part 122 when they are properly pushed by the blade terminal 220 to expand towards the front wall 111 and the rear wall 112. Moreover, the clearances t are provided to hold and prevent excessive deformation of the two branches 122*a* when they are pried by the blade terminal 220.

Accordingly, in the case of the above-mentioned first embodiment, as shown in FIG. 8 and FIG. 9, when a fuse 200 is fitted into the fuse holder 100, the blade terminals 220 and at least a part of the body 210 will be received in the chamber 115 of the holder housing 110, and the blade terminals 220 will be fitted into the connecting parts 122 of the contacts 120. When the legs 123 of the contacts 120 are soldered or press-fitted onto the printed circuit board 300, the fuse holder 100 with the fuse 200 fitted in position will be mounted on the printed circuit board 300. When conductive parts such as electric wires are connected to the pattern of the printed circuit board 300, the fuse 200 will be electrically connected to the conductive parts. When the printed circuit board 300 is loaded in a casing or the like, a fuse fitting device will be produced. With the use of this fuse holder 100, a fuse fitting device can be produced for any combination of fuses 200 without newly designing a block. Thus the production cost is reduced. When a fuse fitting device is produced, fuses 200 may be fitted into the fuse holders 100 after the fuse holders 100 have been mounted on a printed circuit board 300.

The present invention does not limit the configuration of the connecting part of the contact. For example, the present invention includes embodiments wherein the connecting part is formed with a coiled spring and the contact pressure between the contact and the blade terminal is secured by the coiled spring. Among the embodiments of the present invention, in the case of the above-mentioned first embodiment, the connecting part 122 of the contact 120 is formed into a fork shape that can expand towards the front wall 111 and the rear wall 112, and the clearances t between the connecting part 122 and the front wall 111 and the rear wall 112 of the holder housing 110 allow deformation of the connecting part 122 while limiting its excessive deformation. With these arrangements, as the contact 120 is fork-shaped, the production cost is lower in comparison with a case wherein contacts with coiled spring ends are used. When the connecting part 122 of the contact 120 is deformed, the connecting part 122 will be restrained from excessive deformation by the front wall 111 and the rear wall 112 of the holder housing 110, and in turn, the connecting part 122 will be prevented from being pried by the blade terminal 220.

The present invention includes embodiments wherein the holder housing is not provided with any supporting part. Among the embodiments of the present invention, in the case of the above-mentioned first embodiment, supporting parts 116 are provided on the tops of the left wall 113 and the right wall 114 of the holder housing 110. With this arrangement, fitting the ribs 211 into the supporting parts 116 will accurately determine the relative positions of the fuse 200 and the fuse holder 100 to each other, and the blade terminals 220 will be prevented from prying the connecting parts 122. Moreover, the fuse 200 will be held more securely in the fuse holder 100.

The present invention includes embodiments wherein the holder housing is not provided with any slit. Among embodiments of the present invention, in the case of the above-mentioned first embodiment, the holder housing 110 is provided with slits 117. With this arrangement, fitting the side edges 221 into the slits 117 will accurately determine the relative positions of the fuse 200 and the fuse holder 100 to each other, and the blade terminals 220 will be prevented from prying the connecting parts 122. Moreover, the fuse 200 will be held more securely in the fuse holder 100.

The present invention does not limit the structure for fixing the intermediate part of the contact to the holder housing. Among the embodiments of the present invention, in the case of the above-mentioned first embodiment, the intermediate part 121 of the contact 120 is press-fitted into a space between the wall 111 and the wall 112 at the bottom 110*b* of the holder housing 110. With this arrangement, the production method is easy to execute among the production methods wherein the contacts 120 and the holder housing 110 are separately formed and then combined together.

The present invention does not limit the configuration of the leg 123 of the contact 120. Among the embodiments of the present invention, in the case of the above-mentioned first embodiment, the leg 123 of the contact 120 is formed into two branches. With this arrangement, the contact 120 will be connected to the printed circuit board 300 at two points, and defective connection will hardly occur.

The present invention includes embodiments wherein the holder housing is not provided with any boss. Among the embodiments of the present invention, in the case of the above-mentioned first embodiment, the bottom 110*b* of the holder housing 110 is provided with two bosses 118, 119 in positions that are asymmetric to each other in relation to a line L, which runs, when seen from the bottom, between the front wall 111 and the rear wall 112. With this arrangement, when holes corresponding to the bosses 118, 119 are made in advance in the printed circuit board 300, mounting in wrong orientation of the fuse holder 100 on the printed circuit board 300 will be prevented.

In the following, other embodiments will be described. The description of the first embodiment will apply in its entirety as the description of each embodiment, and the same reference character will be used for the same member, and only parts that differ in construction from those of the first embodiment will be described.

FIG. 10 through FIG. 18 show the second embodiment fuse holder 100. A mini-type fuse 200 is fitted into this fuse holder 100. This fuse holder 100 differs from the first embodiment fuse holder 100 in the following points. As the fuse 200 has no ribs 211, the holder housing 110 is not provided with any supporting part 116. The leg 123 of the contact 120 is not forked into two branches. However, the embodiments of the fuse holder 100, into which such a mini-type fuse 200 is fitted, include embodiments wherein the leg 123 of the contact 120 is forked into two branches.

Figure 19:
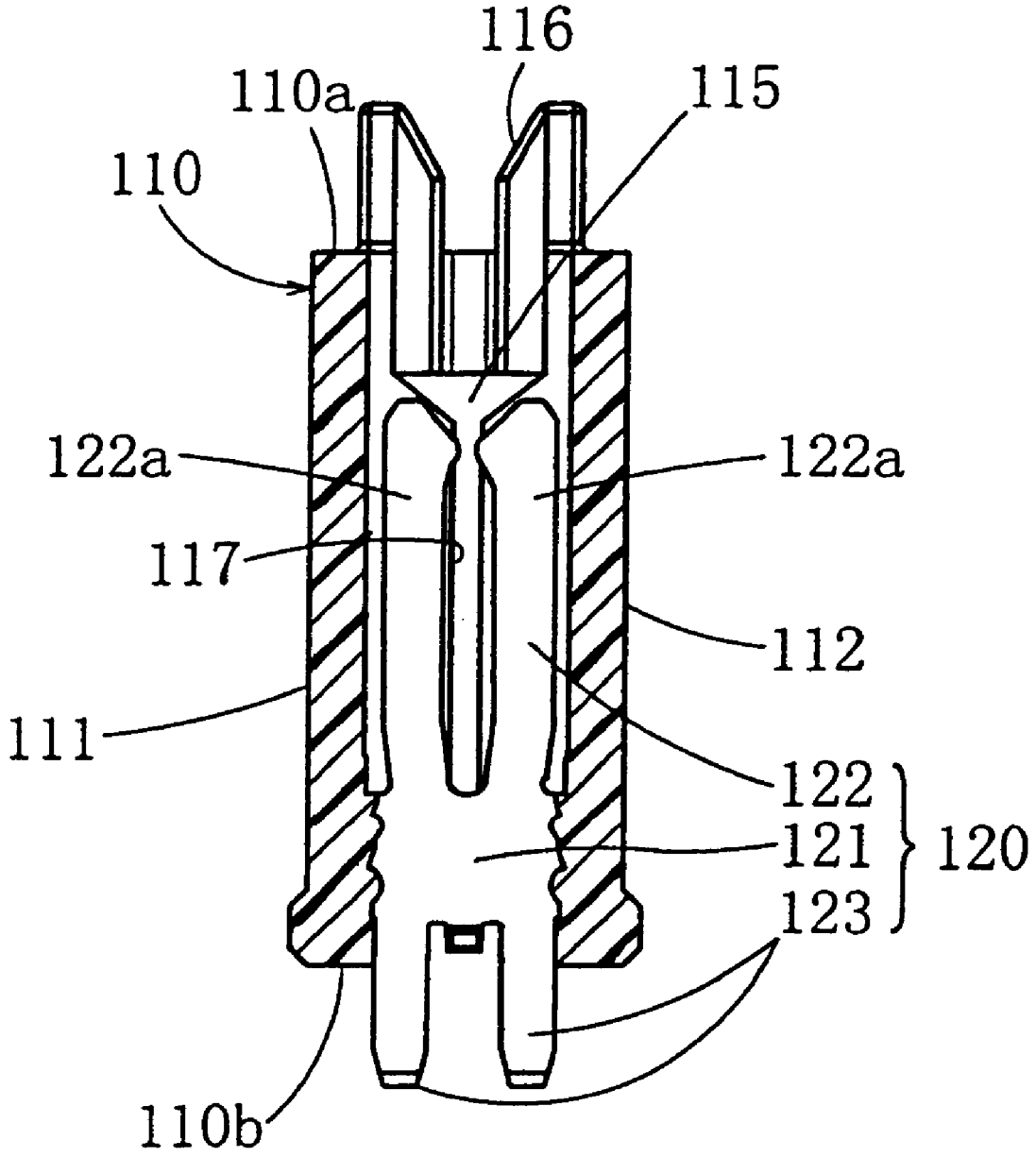
FIG. 19 is a vertical sectional view of the third embodiment of the fuse holder cut in both the front wall and the rear wall thereof.

FIG. 19 shows the third embodiment fuse holder. The third embodiment differs from the first embodiment in the method of fixing the contacts 120 to the holder housing 110. In the third embodiment, the intermediate parts 121 of the contacts 120 are enveloped-cast in the holder housing 110. Enveloped-casting means that a material in a molten state adheres to and envelops an object and then solidifies over the object. In production of the fuse holder 100, contacts 120 are set in the mold of the holder housing 110, then the material is filled in the mold to form the holder housing 110. In this way, relative positions of the contacts 120 and the holder housing 110 will be determined with high precision to each other.

Figure 20:
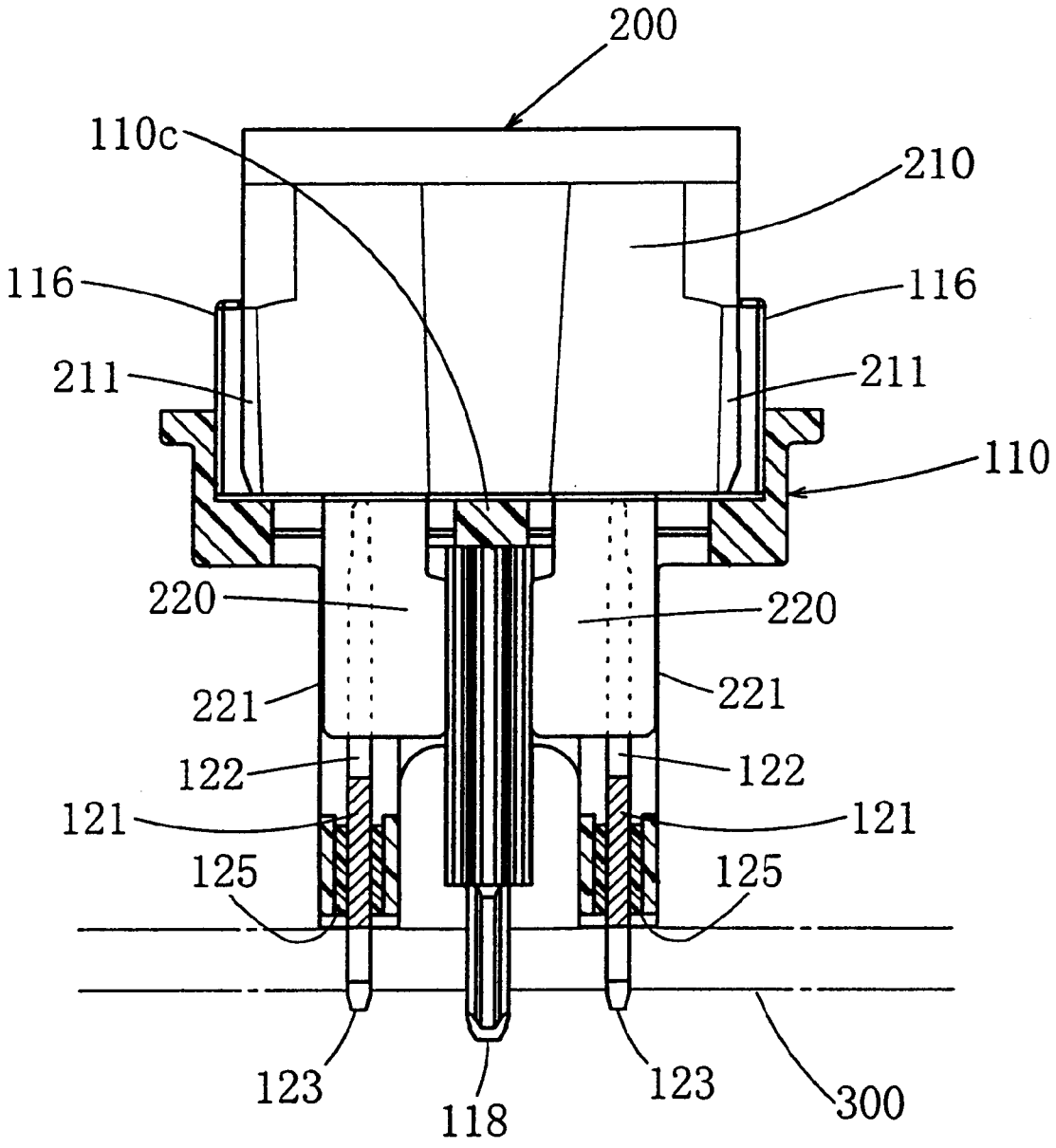
FIG. 20 is a vertical sectional view of the fourth embodiment of the fuse holder cut in both the left wall and the right wall thereof.
Figure 21:
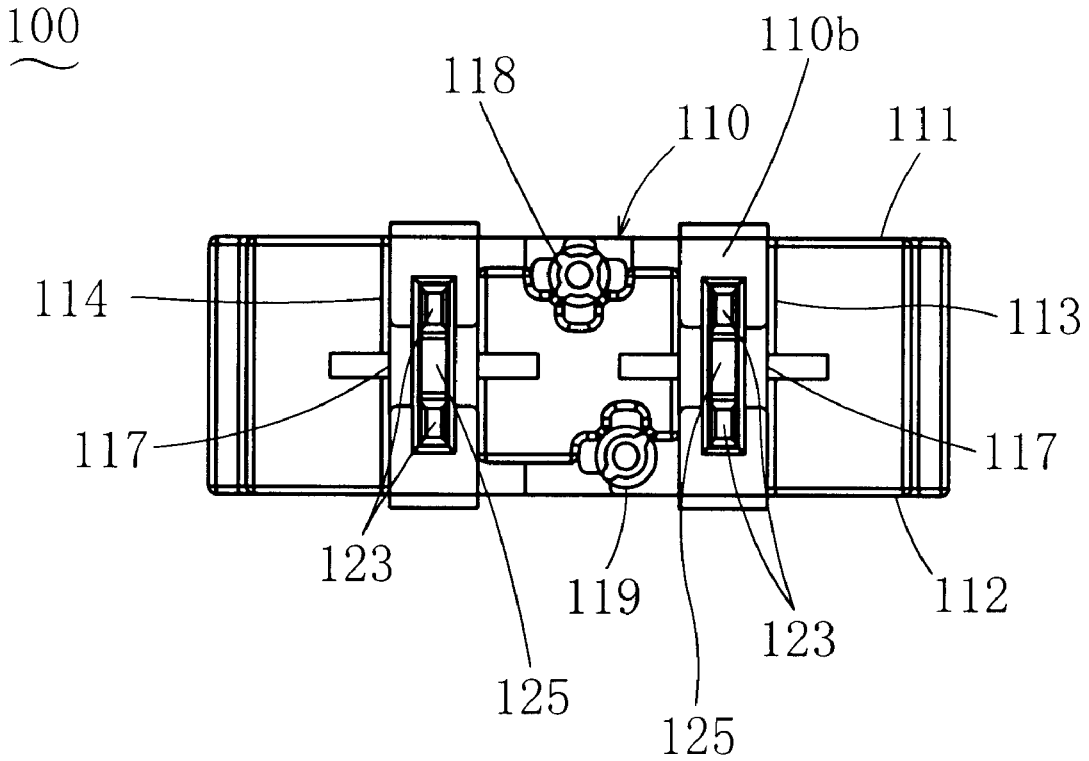
FIG. 21 is a bottom view of the fourth embodiment of the fuse holder.
Figure 22:
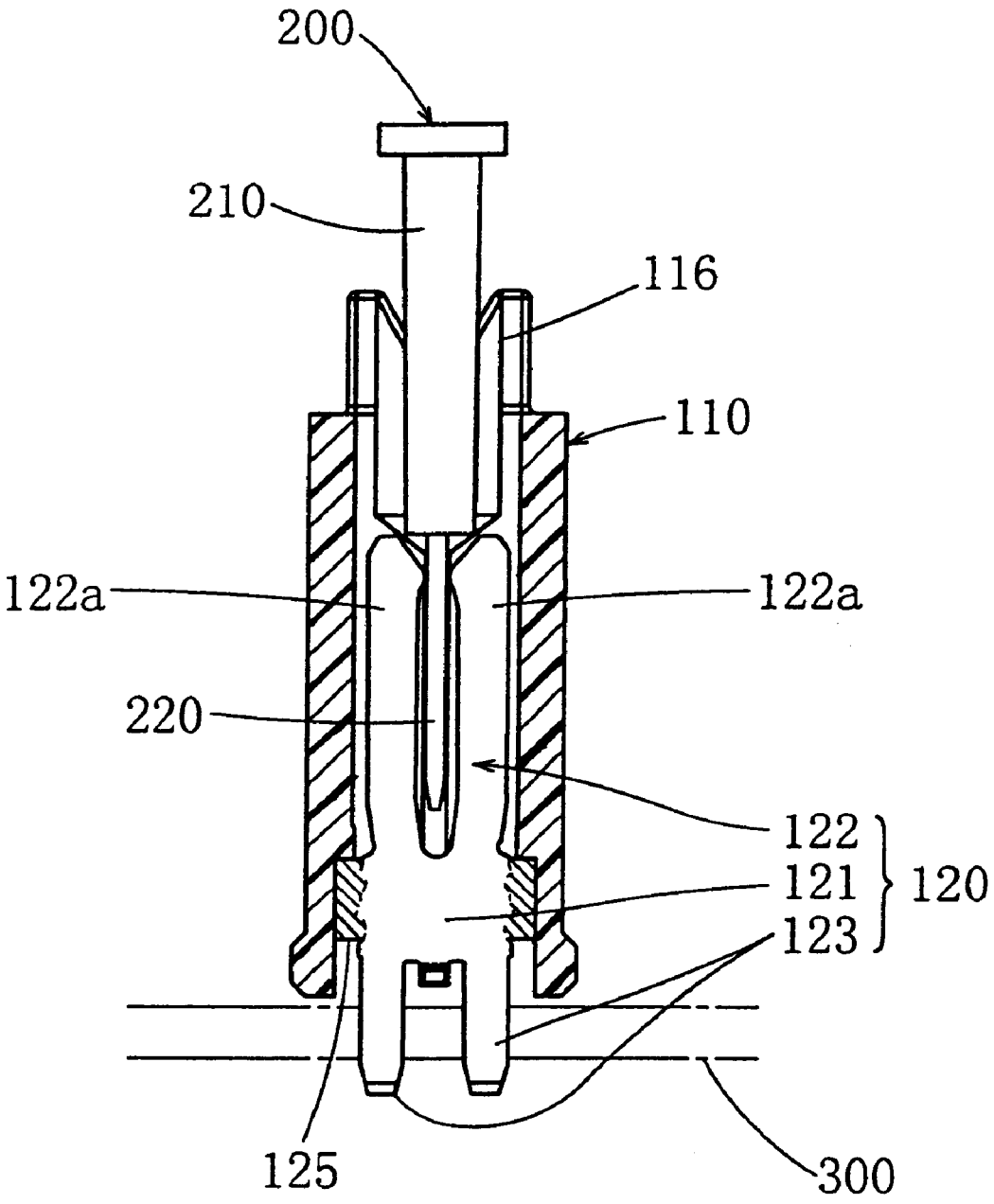
FIG. 22 is a vertical sectional view of the fourth embodiment of the fuse holder cut in both the front wall and the rear wall thereof.

FIG. 20 through FIG. 22 show the fourth embodiment fuse holder. The fourth embodiment differs from the first embodiment in the method of fixing the contacts 120 to the holder housing 110. In the fourth embodiment, the intermediate part 121 of the contact 120 is enveloped-cast in an insert 125 and this insert 125 is fitted into a space among the walls 111 through 114 at the bottom 110*b* of the holder housing 110. With this arrangement, molding of the holder housing 110 and enveloped-casting of inserts 125 are made separately, and each can be done under optimal conditions.

Figure 23:
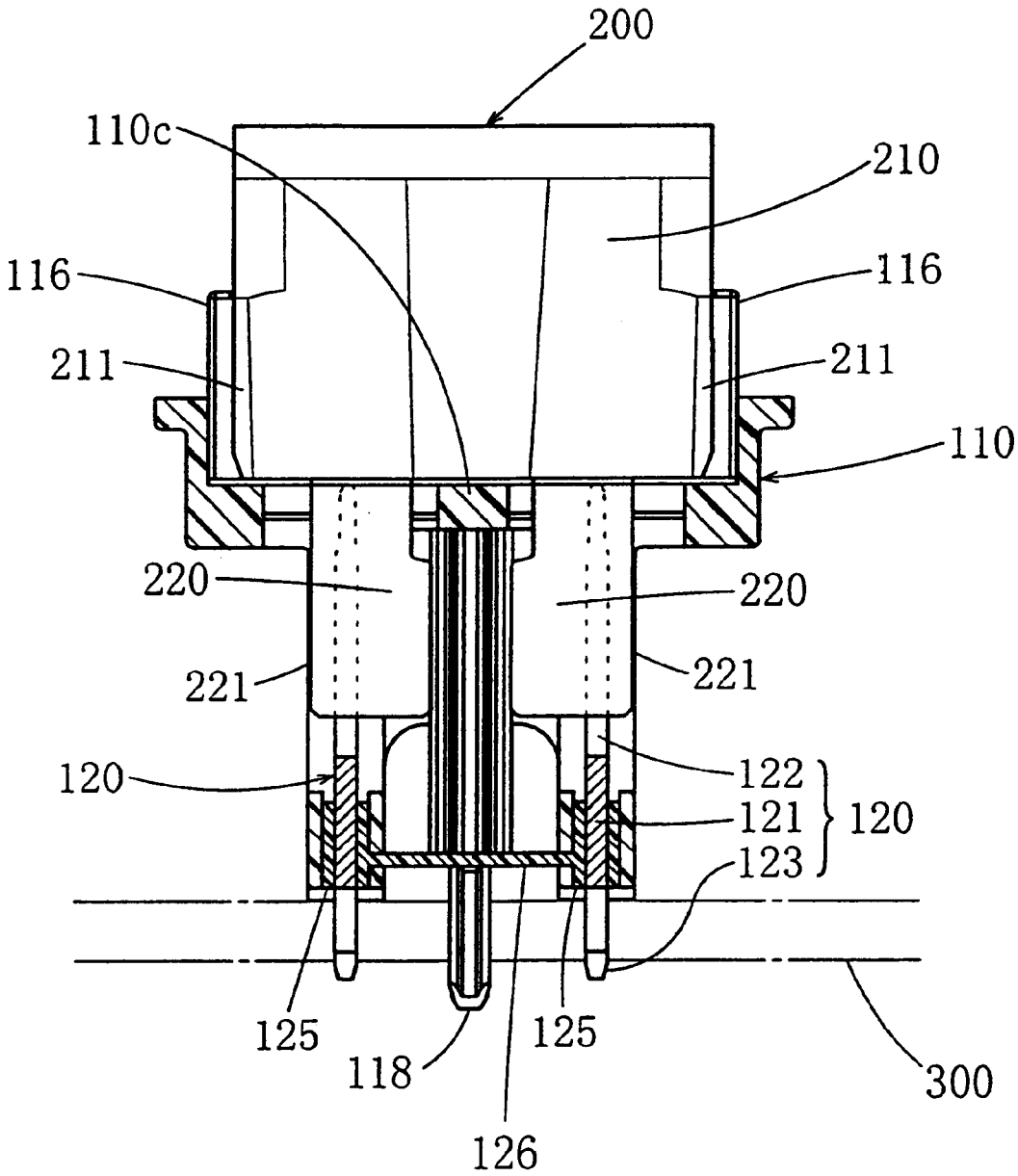
FIG. 23 is a vertical sectional view of the fifth embodiment of the fuse holder cut in both the left wall and the right wall thereof.
Figure 24:
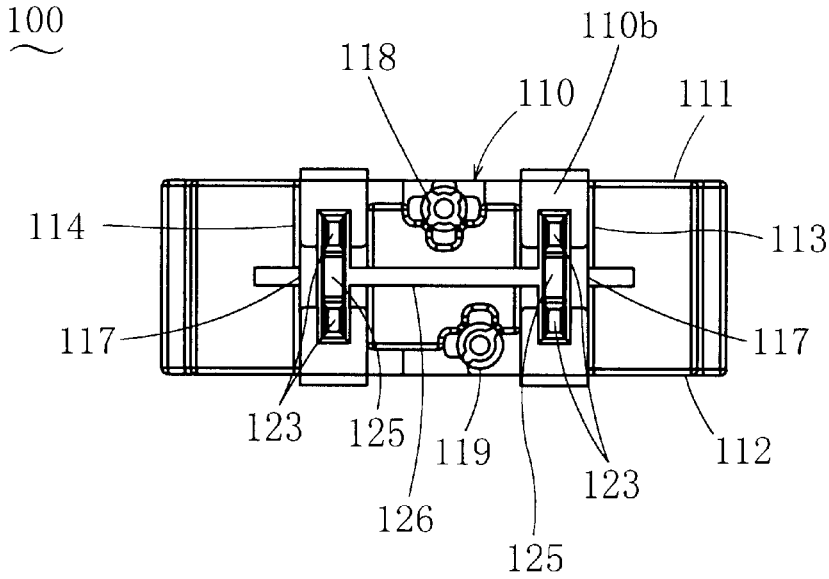
FIG. 24 is a bottom view of the fifth embodiment of the fuse holder.

FIG. 23 and FIG. 24 shows the fifth embodiment fuse holder. The fifth embodiment differs from the fourth embodiment in the configuration of the insert. The two inserts 125 corresponding to the respective contacts 120 are coupled by a bridge 126. With this arrangement, inserting the inserts 125 having the contact 120 into the holder housing 110 can be done by a single operation.

The present invention does not limit the material of the insert 125. However, when the insert 125 is formed of a material, of which heat resistance is superior to that of the holder housing 110, the heat resistance of the holder housing 110 will not pose any problem even if the inserts 125 are subjected to heat of soldering. Hence the holder housing 100 can be made of a more inexpensive material.

Figure 25:
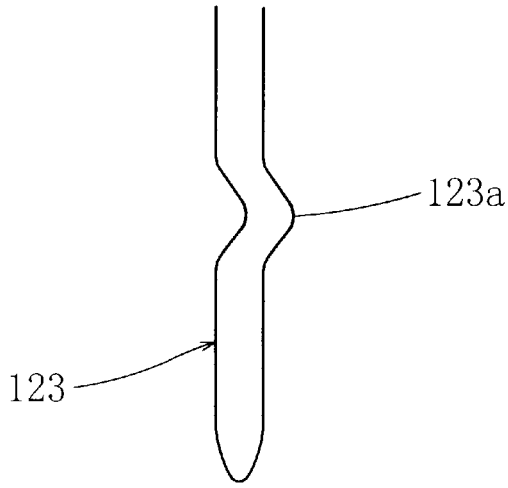
FIG. 25 is an enlarged view showing the leg of the contact of the sixth embodiment of the fuse holder.
Figure 26:
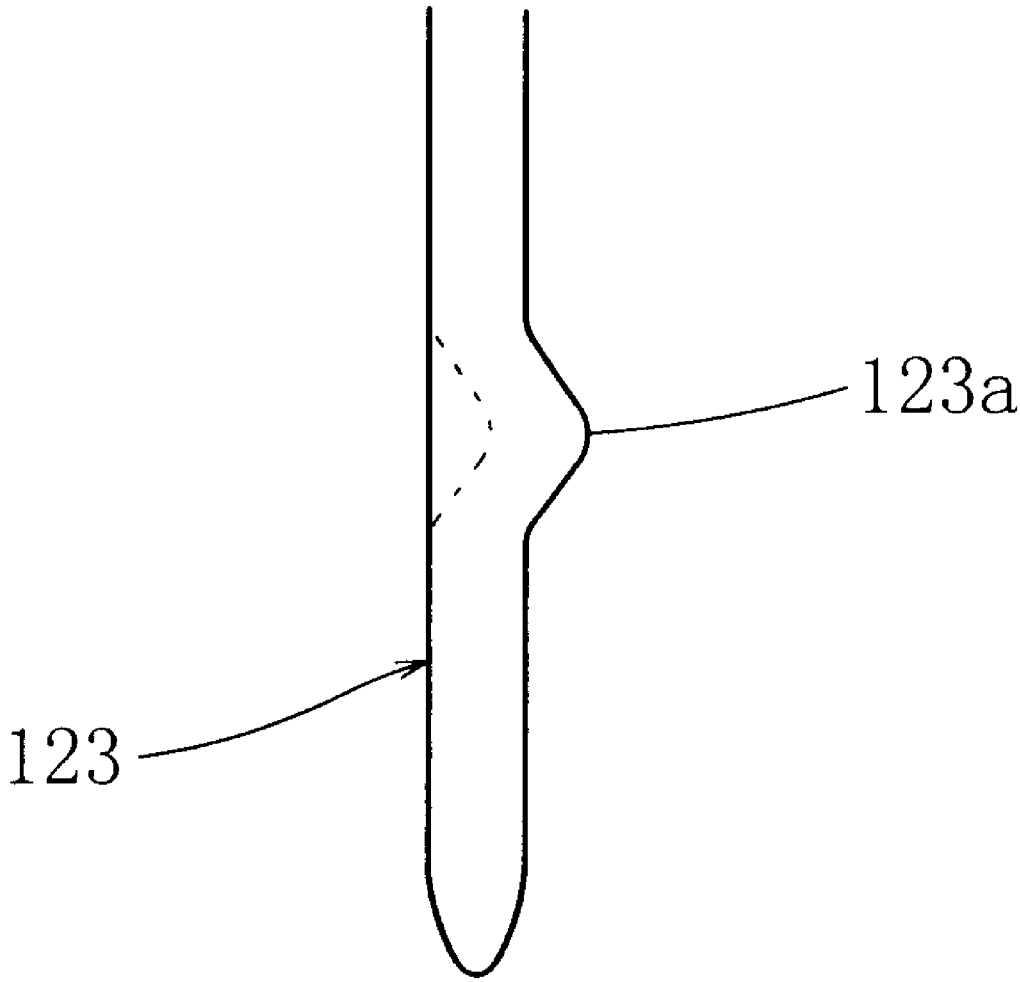
FIG. 26 is an enlarged view showing a variation of the leg of the contact of the sixth embodiment of the fuse holder.

FIG. 25 and FIG. 26 show the sixth embodiment fuse holder. In this embodiment, a protrusion 123*a* is formed in the leg 123 of the contact 120. This protrusion 123*a* is also called a clinch. The protrusion 123*a* may be formed, as shown in FIG. 25, by bending the leg 123 sidewise to form a V shape, or as shown in FIG. 26, by making a part of the leg 123 protrude sidewise. With this arrangement, when the leg 123 of the contact 120 is to be tacked onto a printed circuit board 300 before soldering, fitting the leg 123 of the contact 120 into a hole in the printed circuit board 300 will generate a greater fitting force at the protrusion 123*a*. Thus tacking can be done reliably.

The present invention does not limit the color of the holder housing 110. However, if the holder housing 110 has the same color as that of the body 210 of the fuse 200, the proper fuse 200 for the fuse holder 100 can be identified easily.

The present invention includes embodiments that combine features of the above-mentioned embodiments.

With the description of these embodiments, the first fuse holder, which was described in the summary of the invention, has been fully disclosed. Moreover, with the description of these embodiments, the second fuse holder through the thirteenth fuse holder, which will be described below, have been fully explained.

The second fuse holder is a fuse holder as recited in the above-mentioned first fuse holder, wherein the connecting part of the contact is formed into a fork shape, which can be expanded towards the front wall and the rear wall of the holder housing, and the clearances between the connecting part and the front wall and the rear wall are set in such a way that they allow deformation of the connecting part while limiting its excessive deformation. With this arrangement, as the contact has a fork shape, the production cost is lower than that of a contact having a coiled spring at the top end thereof. When the connecting part of the contact is deformed, the connecting part will be prevented from excessive deformation by the front wall and the rear wall of the holder housing, thus the connecting part will be prevented from being pried by the blade terminal. Hence a high level of performance of the fuse fitting device can be guaranteed.

The third fuse holder is a fuse holder as recited in the above-mentioned first or second fuse holder, wherein U-shaped supporting parts, into which ribs provided in side ends of the body of the fuse are to be fitted, are provided on the tops of the left wall and the right wall of the holder housing. With this arrangement, fitting the ribs in the supporting parts will accurately determine the relative positions of the fuse and the fuse holder to each other, the blade terminals will be prevented from prying the connecting parts, and a higher level of performance of the fuse fitting device can be guaranteed. Moreover, the fuse will be held more securely in the fuse holder.

The fourth fuse holder is a fuse holder as recited in any one of the above-mentioned first through third fuse holders, wherein the left wall and the right wall of the holder housing are provided with a slit, into which a side edge of the blade terminal is fitted. With this arrangement, fitting the side edges into the slits will accurately determine the relative positions of the fuse and the fuse holder to each other, the blade terminals will be prevented from prying the connecting parts, and a higher level of performance of the fuse fitting device can be guaranteed. Moreover, the fuse will be held more securely in the fuse holder.

The fifth fuse holder is a fuse holder as recited in any one of the above-mentioned first through fourth fuse holders, wherein the intermediate part of the contact is press-fitted into a space between the walls at the bottom of the holder housing. With this arrangement, the production method is easy to execute among the production methods wherein the contacts and the holder housing are separately formed and then combined together. Thus the fuse holder can be produced with efficiency.

The sixth fuse holder is a fuse holder as recited in any one of the above-mentioned first through fourth fuse holders, wherein the intermediate parts of the contacts are enveloped-cast in the holder housing. With this arrangement, the relative positions of the contacts and the holder housing can be determined with high precision to each other.

The seventh fuse holder is a fuse holder as recited in any one of the above-mentioned first through fourth fuse holders, wherein the intermediate part of the contact is enveloped-cast in an insert and this insert is fitted into a space among the walls at the bottom of the holder housing. With this arrangement, molding of the holder housing and enveloped-casting of inserts are made separately, and each can be done under optimal conditions.

The eighth fuse holder is a fuse holder as recited in the above-mentioned seventh fuse holder, wherein two inserts are coupled together. With this arrangement, inserting the inserts having the contact into the holder housing can be done by a single operation. Thus the efficiency of the assembly can be enhanced.

The ninth fuse holder is a fuse holder as recited in the above-mentioned seventh or eighth fuse holder, wherein the insert is formed of a material, of which heat resistance is superior to that of the holder housing. With this arrangement, the heat resistance of the holder housing will not pose any problem even if the insert is subjected to heat of soldering. Hence the holder housing can be made of a more inexpensive material.

The tenth fuse holder is a fuse holder as recited in any one of the above-mentioned first through ninth fuse holders, wherein the leg of the contact is forked into two branches. With this arrangement, the contact will be connected to the printed circuit board at two points, and defective connection between the fuse holder and the printed circuit board can be prevented.

The eleventh fuse holder is a fuse holder as recited in any one of the above-mentioned first through tenth fuse holders, wherein a protrusion is formed in the leg of the contact. With this arrangement, when the leg of the contact is to be tacked onto a printed circuit board before soldering, fitting the leg of the contact into a hole in the printed circuit board will generate a greater fitting force at the protrusion. Thus tacking will be done reliably.

The twelfth fuse holder is a fuse holder as recited in any one of the above-mentioned first through eleventh fuse holders, wherein the bottom of the holder housing is provided with two bosses in positions that are asymmetric to each other in relation to a line, which runs, when seen from the bottom, between the front wall and the rear wall approximately in parallel with these walls. With this arrangement, when holes corresponding to the bosses are made in advance in the printed circuit board, mounting, in wrong orientation, of the fuse holder on the printed circuit board will be prevented.

The thirteenth fuse holder is a fuse holder as recited in any one of the above-mentioned first through twelfth fuse holders, wherein the holder housing has the same color as that of the body of the fuse. With this arrangement, the proper fuse for the fuse holder can be identified easily.

What is claimed is:

1. A fuse holder, into which a blade type fuse, with blade terminals protruding from the body thereof, is fittable, said fuse holder comprising:

a holder housing having wide front and rear walls at the front and the rear and narrow right and left walls on the right and the left, wherein inner wall surfaces of these walls bound a chamber, which will hold the blade terminals of a fuse inserted from the top side and at least a part of the body of the fuse, and two contacts, each of which has an intermediate part fixed to the holder housing, a connecting part, at one end of the contact, extending into the chamber to fit with a blade terminal, and a leg, at another end of the contact, extending out of the holder housing to be soldered or press-fitted onto a printed circuit board, wherein the inner wall surfaces of the right and left walls of the holder housing have respective slits therein that communicate with the chamber and are adapted to receive respective side edges of the blade terminals of the fuse therein.

2. A fuse holder as recited in claim 1, wherein the connecting part of the contact is formed into a fork shape, which can be expanded towards the front wall and the rear wall of the holder housing, and the clearances between the connecting part and the front wall and the rear wall are set in such a way that they allow deformation of the connecting part while limiting its excessive deformation.

3. A fuse holder as recited in claim 1, wherein

U-shaped supporting parts, into which ribs provided in side ends of the body of the fuse are to be fitted, are provided on the tops of the left wall and the right wall of the holder housing.

4. A fuse holder as recited in claim 1, wherein the intermediate part of the contact is press-fitted into a space between the walls at the bottom of the holder housing.

5. A fuse holder as recited in claim 1, wherein the intermediate parts of the contacts are enveloped-cast in the holder housing.

6. A fuse holder as recited in claim 1, wherein the leg of the contact is forked into two branches.

7. A fuse holder as recited in claim 1, wherein a protrusion is formed in the leg of the contact.

8. A fuse holder as recited in claim 1, wherein the bottom of the holder housing is provided with two bosses in positions that are asymmetric to each other in relation to a line, which runs, when seen from the bottom, between the front wall and the rear wall approximately in parallel with these walls.

9. A fuse holder as recited in claim 1, wherein the holder housing has the same color as that of the body of the fuse.

10. A fuse holder as recited in claim 1, wherein the slits are respective open passages that pass entirely through the right and left walls and are open on outer wall surfaces of the right and left walls such that the side edges of the blade terminals received therein are outwardly exposed.

11. A fuse holder as recited in claim 1, wherein the intermediate part of the contact is enveloped-cast in an insert and this insert is fitted into a space among the walls at the bottom of the holder housing.

12. A fuse holder as recited in claim 11, wherein two inserts are coupled together.

13. A fuse holder as recited in claim 11, wherein the insert is formed of a material, of which heat resistance is superior to that of the holder housing.

14. A fuse holder, into which a blade type fuse, with blade terminals protruding from the body thereof, is fittable, said fuse holder comprising:

a holder housing having wide front and rear walls at the front and the rear and narrow right and left walls on the right and the left, wherein inner wall surfaces of these walls bound a chamber, which will hold the blade terminals of a fuse inserted from the top side and at least a part of the body of the fuse, and two contacts, each of which has an intermediate part fixed to the holder housing, a connecting part, at one end of the contact, extending into the chamber to fit with a blade terminal, and a leg, at another end of the contact, extending out of the holder housing to be soldered or press-fitted onto a printed circuit board, wherein the intermediate part of each contact is enveloped-cast in an insert and this insert is fitted into a space among the walls at a bottom of the holder housing, and two of the inserts are coupled together.

15. A fuse holder, into which a blade type fuse, with blade terminals protruding from the body thereof, is fittable, said fuse holder comprising:

a holder housing having wide front and rear walls at the front and the rear and narrow right and left walls on the right and the left, wherein inner wall surfaces of these walls bound a chamber, which will hold the blade terminals of a fuse inserted from the top side and at least a part of the body of the fuse, and two contacts, each of which has an intermediate part fixed to the holder housing, a connecting part, at one end of the contact, extending into the chamber to fit with a blade terminal, and a leg, at another end of the contact, extending out of the holder housing to be soldered or press-fitted onto a printed circuit board, wherein the intermediate part of each contact is enveloped-cast in an insert and this insert is fitted into a space among the walls at a bottom of the holder housing, and wherein the insert is formed of a material having a greater heat resistance than that of the holder housing.

* * * * *

UNITED STATES PATENT AND TRADEMARK OFFICE

CERTIFICATE OF CORRECTION

PATENT NO. : 6,666,722 B2
DATED : December 23, 2003
INVENTOR(S) : Fukumori et al.

It is certified that error appears in the above-identified patent and that said Letters Patent is hereby corrected as shown below:

Title page,
Item [75], Inventors, replace "Van Dessel Sonny" by -- Sonny VAN DESSEL --;

Signed and Sealed this

Thirtieth Day of March, 2004

JON W. DUDAS
*Acting Director of the United States Patent and Trademark Office*